US007948350B2

(12) United States Patent
Shoji et al.

(10) Patent No.: US 7,948,350 B2
(45) Date of Patent: May 24, 2011

(54) COIL COMPONENT

(75) Inventors: Atsushi Shoji, Tokyo (JP); Masatoshi Shindoh, Tokyo (JP)

(73) Assignee: TDK Corporation, Tokyo (JP)

( * ) Notice: Subject to any disclaimer, the term of this patent is extended or adjusted under 35 U.S.C. 154(b) by 7 days.

(21) Appl. No.: 12/429,537

(22) Filed: Apr. 24, 2009

(65) Prior Publication Data

US 2009/0278652 A1 Nov. 12, 2009

(30) Foreign Application Priority Data

May 8, 2008 (JP) ..... 2008-122466

(51) Int. Cl.

| | |
|---|---|
| ***H01F 27/02*** | (2006.01) |
| ***H01F 29/06*** | (2006.01) |
| ***H01F 27/30*** | (2006.01) |
| ***H01F 17/04*** | (2006.01) |
| ***H01F 27/08*** | (2006.01) |

(52) U.S. Cl. ..... 336/221; 336/82; 336/83; 336/141; 336/208; 336/222

(58) Field of Classification Search ..... 336/82, 336/83, 141, 149, 221, 222, 208
See application file for complete search history.

(56) References Cited

U.S. PATENT DOCUMENTS

| | | | | |
|---|---|---|---|---|
| 7,397,334 | B2 | 7/2008 | Yoshida et al. | |
| 2006/0268457 | A1 * | 11/2006 | Sano | 360/126 |
| 2007/0216377 | A1 | 9/2007 | Yoshimura | |

FOREIGN PATENT DOCUMENTS

| | | |
|---|---|---|
| JP | U-1-71410 | 5/1989 |
| JP | A-9-215318 | 8/1997 |
| JP | A-10-55923 | 2/1998 |
| JP | A-10-233325 | 9/1998 |
| JP | A-2005-243807 | 9/2005 |
| JP | A-2005-353989 | 12/2005 |
| JP | A-2007-250891 | 9/2007 |
| JP | 2007273757 A * | 10/2007 |

OTHER PUBLICATIONS

Japanese Office Action for Application No. 2008-122466, issued Jan. 19, 2010.

* cited by examiner

*Primary Examiner* — Anh T Mai
*Assistant Examiner* — Ronald W Hinson
(74) *Attorney, Agent, or Firm* — Oliff & Berridge, PLC

(57) ABSTRACT

A coil component has a first core with a winding core portion, a second core with a winding core portion, a first coil wound on the winding core portion of the first core, and a second coil wound on the winding core portion of the second core. A part of the first coil is wound on the winding core portion of the second core. The first core and the second core are arranged as magnetically separated from each other.

5 Claims, 8 Drawing Sheets

COIL COMPONENT

BACKGROUND OF THE INVENTION

1. Field of the Invention

The present invention relates to a coil component.

2. Related Background Art

There is a conventionally known coil component, for example, as described in Japanese Patent Application Laid-open No. 10-233325. The coil component described in this Application Laid-open No. 10-233325 has an I-shaped core set in a hollow portion of a coil bobbin, an E-shaped core coupled to this I-shaped core, and a primary winding and a secondary winding wound around the I-shaped core. In this coil component, there are the following two magnetic paths formed: a first magnetic path including a first winding portion in which the primary winding and a part of the secondary winding are wound; and a second magnetic path including a second winding portion in which only the rest part of the secondary winding is wound.

SUMMARY OF THE INVENTION

However, since the core portions with the primary winding and the secondary winding wound thereon are integrated in the coil component described in the foregoing Application Laid-open No. 10-233325, there is a common magnetic path produced by the two windings (coils) in the cores. Therefore, in order to adjust the coupling coefficient between the two coils, it is necessary to take influence of the common magnetic path into consideration and the adjustment of the coupling coefficient must be inevitably difficult.

An object of the present invention is to provide a coil component permitting easy adjustment of the coupling coefficient between two coils.

The present invention provides a coil component comprising: a first core having a winding core portion; a second core having a winding core portion; a first coil wound on the winding core portion of the first core; and a second coil wound on the winding core portion of the second core, wherein a part of the first coil is wound on the winding core portion of the second core, and wherein the first core and the second core are arranged as magnetically separated from each other In the coil component of the present invention, a part of the first coil wound on the winding core portion of the first core is also wound on the winding core portion of the second core, whereby the first coil and the second coil are magnetically coupled to each other. Therefore, a desired coupling coefficient between the two coils can be obtained, for example, by adjusting a winding ratio of the first coil on the winding core portions of the first core and the second core. In this connection, since the first core and the second core are arranged as magnetically separated from each other, there is no region sharing a common magnetic path between magnetic paths produced by the first coil and the second coil. For this reason, there is no need for giving consideration to influence of the common magnetic path in adjusting the coupling coefficient between the first coil and the second coil. This facilitates the adjustment of the coupling coefficient between the first coil and the second coil.

Preferably, the coil component further comprises a coupling member which is made of a nonmagnetic material and which couples the first core to the second core. In this case, while integrating the coil component as one component, the first core and the second core can be readily and certainly arranged as magnetically separated from each other.

Preferably, the part of the first coil is directly stretched onto the winding core portion of the second core to be wound thereon. In this case, there is no increase in the number of parts because there is no need for using a separate member for stretching the first coil onto the second core.

Preferably, the part of the first coil is stretched through a connection conductor onto the winding core portion of the second core to be wound thereon. In this case, the first coil can be wound by first individually winding a plurality of windings to form the first coil, on the winding core portions of the first core and the second core and connecting the windings to the connection conductor; therefore, it is easy to implement automatic winding of the first coil by a dedicated winding machine.

More preferably, the connection conductor is a wiring pattern formed on a substrate. In this case, the first coil can be readily stretched onto the second core with the use of the substrate having the wiring pattern.

Preferably, each of the first core and the second core is a drum core further having flanges provided at both ends of the winding core portion. In this case, the first coil and the second coil can be readily wound in layers on the winding core portion of the second core, which is advantageous in mass production.

The present invention enables easy adjustment of the coupling coefficient between two coils. This makes it feasible to readily obtain the coupling coefficient required of the coil component.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the coil component according to the present invention will be described below in detail with reference to the drawings.

Figure 1:
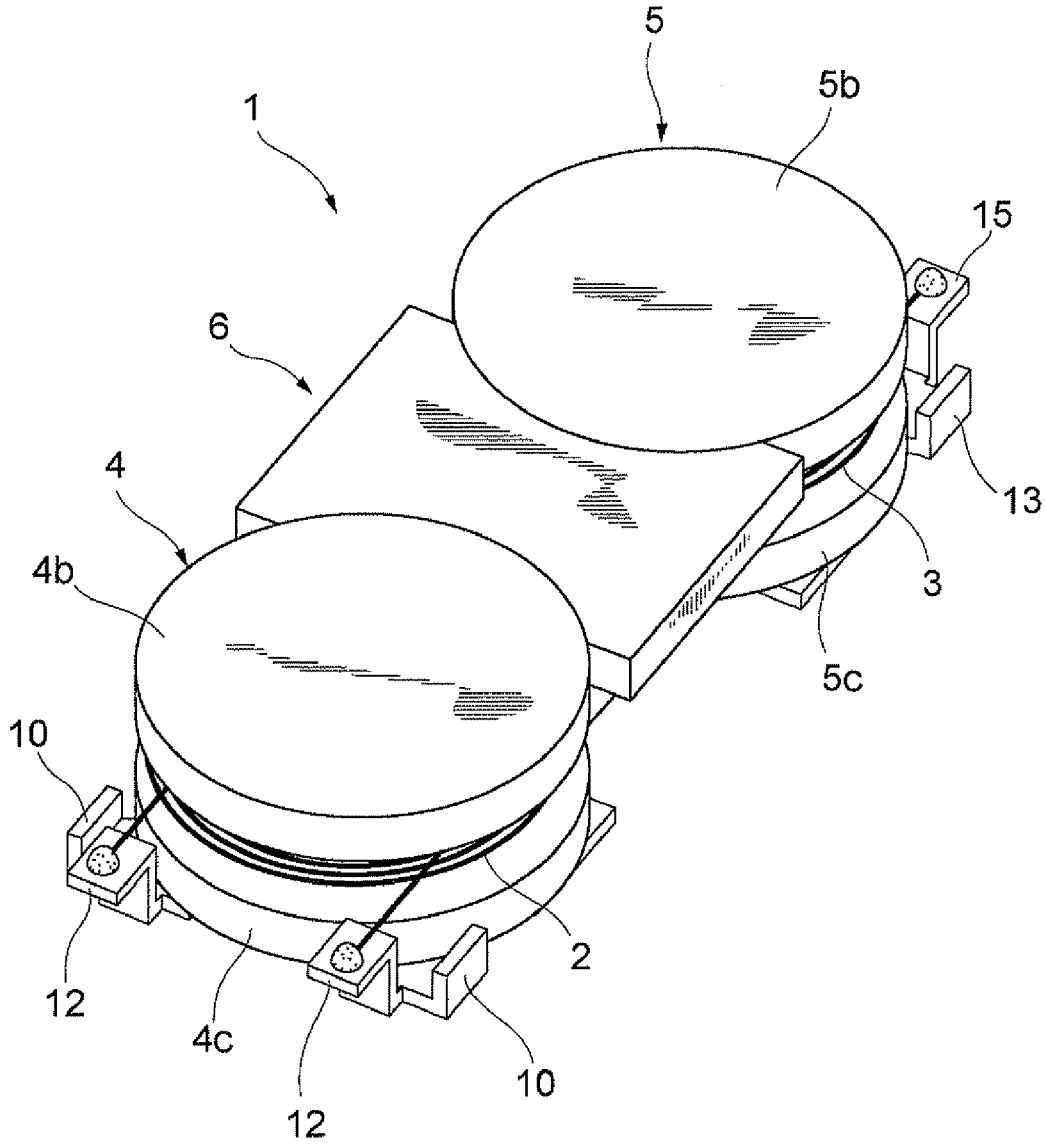
FIG. 1 is a perspective view showing a coil component according to a first embodiment.
Figure 2:
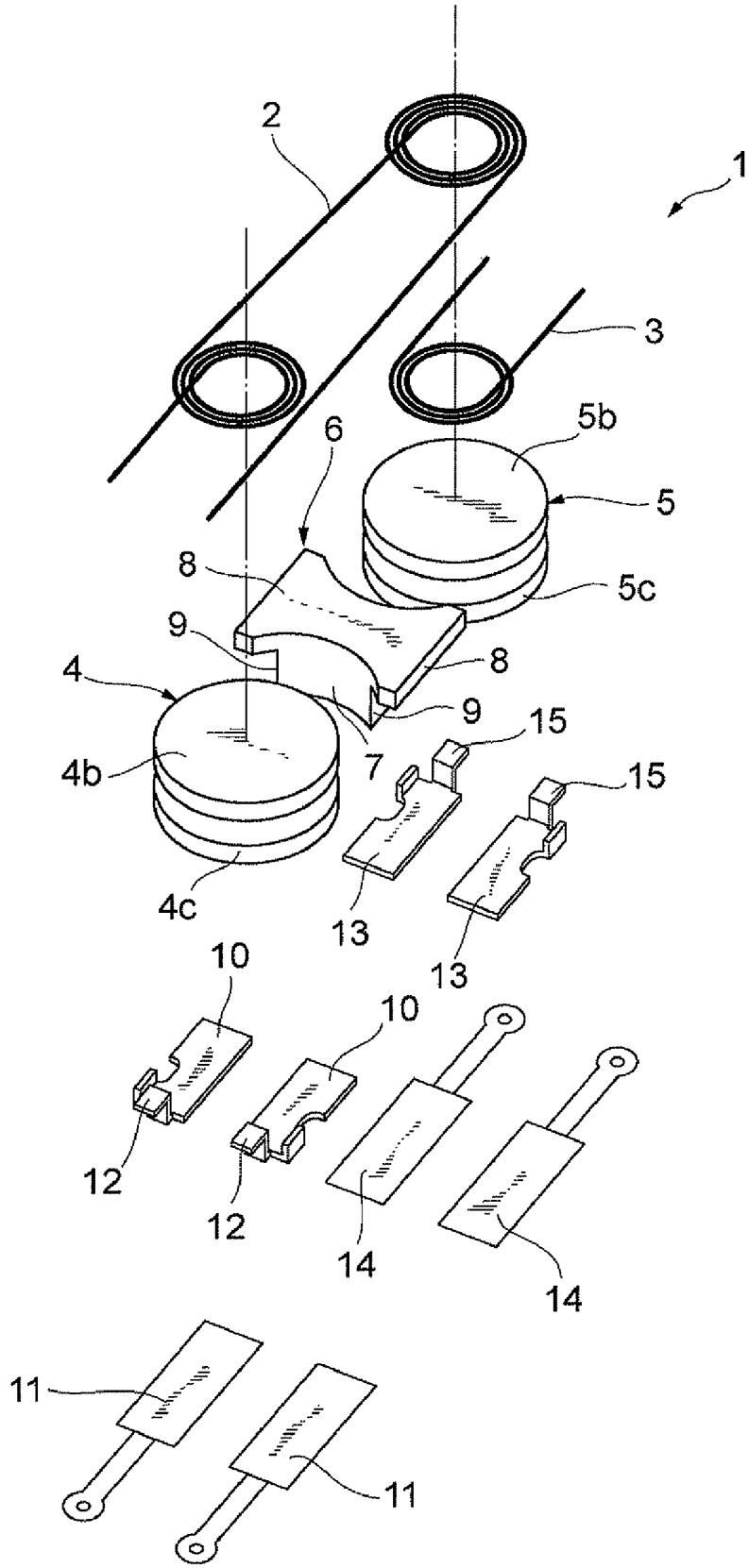
FIG. 2 is an exploded perspective view of the coil component shown in FIG. 1.
Figure 3:
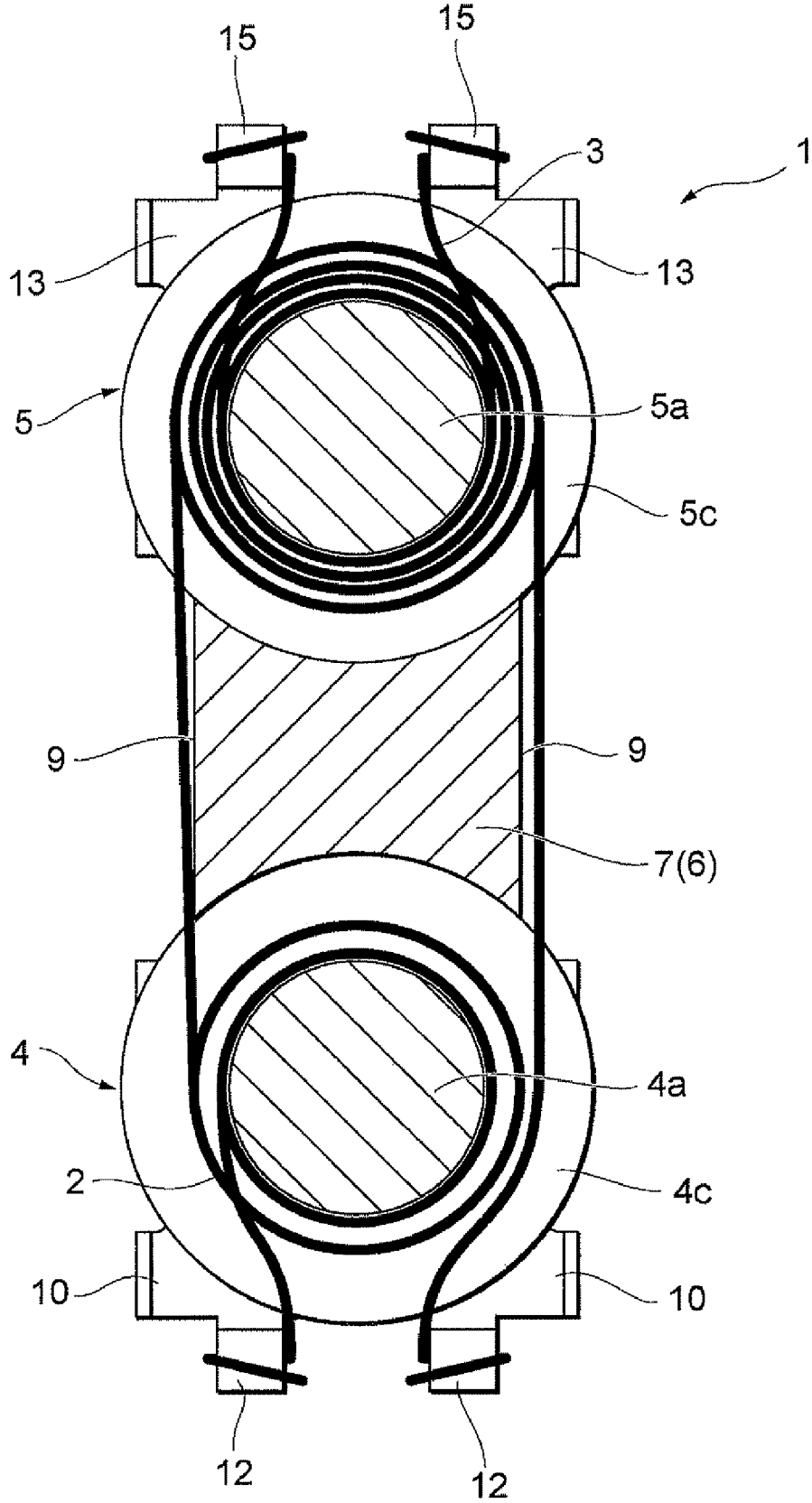
FIG. 3 is a sectional view of the coil component shown in FIG. 1.

FIG. 1 is a perspective view showing the coil component according to the first embodiment. FIG. 2 is an exploded perspective view of the coil component shown in FIG. 1 and FIG. 3 is a sectional view of the coil component shown in FIG. 1. In each drawing, the coil component 1 of the present embodiment is a choke coil for power supply used in a state in which coils 2, 3 are magnetically coupled to each other.

The coil component 1 has drum cores 4, 5, and a coupling member 6 which couples these drum cores 4, 5 to each other The drum cores 4, 5 used herein are those having the same shape, size, and others. The drum core 4 has a winding core portion 4*a*, and flanges 4*b*, 4*c* provided at both ends of the winding core portion 4*a*, respectively. The drum core 5 has a winding core portion 5*a*, and flanges 5*b*, 5*c* provided at both ends of the winding core portion 5*a*, respectively.

The drum cores 4, 5 are made of a magnetic material such as sintered ferrite or composite ferrite (resin containing powder ferrite). For achieving a desired inductance property, the winding core portions 4*a*, 5*a* may be filled with a magnetic-powder-containing resin.

The coupling member 6 is made of a nonmagnetic material, e.g., a ceramic material such as alumina, a sintered nonmagnetic ferrite body, or resin. The coupling member 6 is bonded to a peripheral surface of the upper flange 4*b* of the drum core 4 and to a peripheral surface of the upper flange 5*b* of the drum core 5 with an adhesive or the like. This makes the drum cores 4, 5 arranged as magnetically separated from each other.

The coupling member 6 has a main body 7 having a pair of curved surfaces with the same curvature as that of the peripheral surfaces of the flanges 4*b*, 5*b*, and a pair of overhang portions 8 provided so as to overhang from the main body 7 on both sides. The thickness of the overhang portions 8 is approximately equal to the thickness of the flanges 4*b*, 5*b*. The coupling member 6 is bonded to the peripheral surfaces of the flanges 4*b*, 5*b* so that the upper surfaces of the overhang portions 8 are flush with the upper surfaces of the flanges 4*b*, 5*b*.

A part of the coil 2 is wound on the winding core portion 4*a* of the drum core 4. The coil 3 and the other part of the coil 2 are wound on the winding core portion 5*a* of the drum core 5. Each of the coils 2, 3 is formed of a single copper wire.

The coil 2 is wound by a predetermined number of turns on the winding core portion 4*a* of the drum core 4, directly stretched onto the drum core 5, wound by a predetermined number of turns over the coil 3 on the winding core portion 5*a* of the drum core 5, further bent in U-shape, and directly stretched onto the drum core 4. Since the drum cores 4, 5 used herein are productive, widely used ones, the coils 2, 3 can be readily wound in layers on the winding core portion 5*a* of the drum core 5.

The coil 2 is stretched through under each overhang portion 8 of the coupling member 6 onto the drum cores 4, 5. In the coupling member 6 the two side faces of the main body 7 and the lower surfaces of the respective overhang portions 8 constitute guide portions 9 for guiding the coil 2 during a work of stretching the coil 2 between the drum cores 4, 5.

A pair of metal terminals 10 are bonded to the lower surface of the lower flange 4*c* of the drum core 4 with an adhesive or the like in a state in which they are juxtaposed on both sides. Each metal terminal 10 is to be electrically connected to a land 11 on a circuit board not shown. Each metal terminal 10 has an L-shaped junction portion 12 and the two ends of the coil 2 are connected to the respective junction portions 12.

A pair of metal terminals 13 are bonded to the lower surface of the lower flange 5*c* of the drum core 5 with an adhesive or the like in a state in which they are juxtaposed on both sides. Each metal terminal 13 is to be electrically connected to a land 14 on the circuit board not shown. Each metal terminal 13 has an L-shaped junction portion 15 and the both ends of the coil 3 are connected to the respective junction portions 15.

In the coil component 1 of the present embodiment constructed as described above, a part of the coil 2 is wound on the winding core portion 4*a* of the drum core 4 and the other part of the coil 2 is directly stretched onto the winding core portion 5*a* of the drum core 5 to be wound thereon. Therefore, the coupling coefficient between the coils 2, 3 can be varied by changing a winding ratio of the coil 2 on the drum cores 4, 5.

When magnetic paths are generated in the drum cores 4, 5 by the coils 2, 3, the magnetic path through the drum core 4 and the magnetic path through the drum core 5 are completely separated from each other without any common magnetic path because the drum cores 4, 5 are coupled to each other by the coupling member 6 of the nonmagnetic substance. For this reason, there is no need for adjusting the coupling coefficient between the coils 2, 3, taking influence of the common magnetic path into consideration. Therefore, the coupling coefficient between the coils 2, 3 can be adjusted by simply adjusting the winding ratio of the coil 2 on the drum cores 4, 5. This facilitates the adjustment of the coupling coefficient between coils 2, 3 and it is thus easy to obtain a desired coupling coefficient.

For example, in the case of the coil component wherein the I-shaped core and E-shaped core with coils thereon are coupled to form magnetic paths, a gap is made between abutting surfaces of the I-shaped core and E-shaped core and this gap can be a cause of variation in the inductance property. In contrast to it, the present embodiment prevents such variation in the inductance property. Since there is no common magnetic path in the present embodiment, there is no need for winding the coil 2 with consideration to directions of magnetic paths.

Since a part of the coil 2 wound on the winding core portion 4*a* of the drum core 4 is directly stretched onto the winding core portion 5*a* of the drum core 5 to be wound thereon, there is no need for any member for stretching the coil 2 between the drum cores 4, 5. This can minimize the number of parts necessary for the coil component 1.

Figure 4:
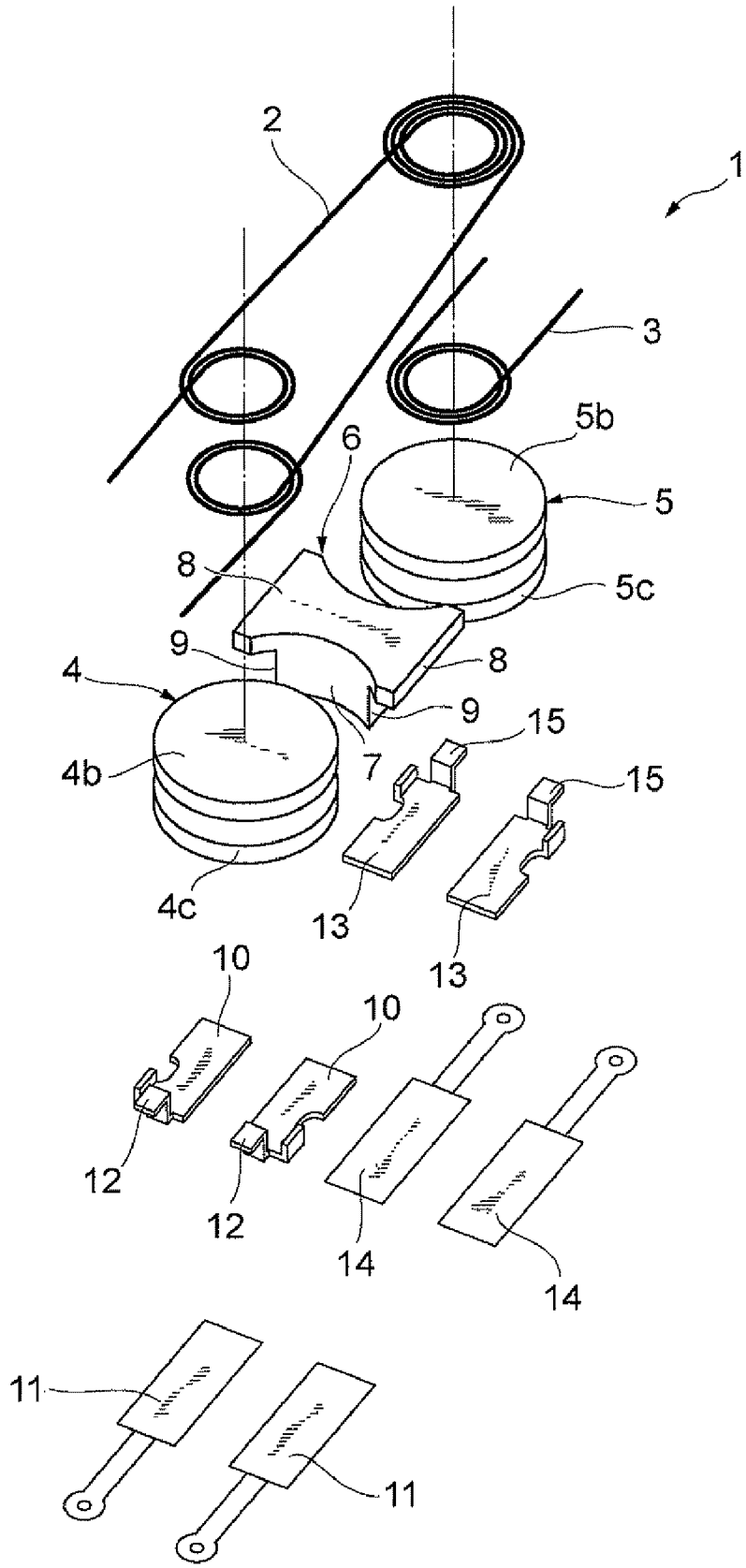
FIG. 4 is an exploded perspective view showing a modification example of the coil component shown in FIG. 2.

FIG. 4 is an exploded perspective view showing a modification example of the coil component 1 of the above first embodiment. In the same drawing, the coil 2 in the present modification example is wound by a predetermined number of turns on the winding core portion 4*a* of the drum core 4, directly stretched onto the drum core 5, wound by a predetermined number of turns on the winding core portion 5*a*, further bent in U-shape, directly stretched onto the drum core 4, and wound by a predetermined number of turns on the winding core portion 4*a*. The other configuration is the same as in the first embodiment described above.

Figure 5:
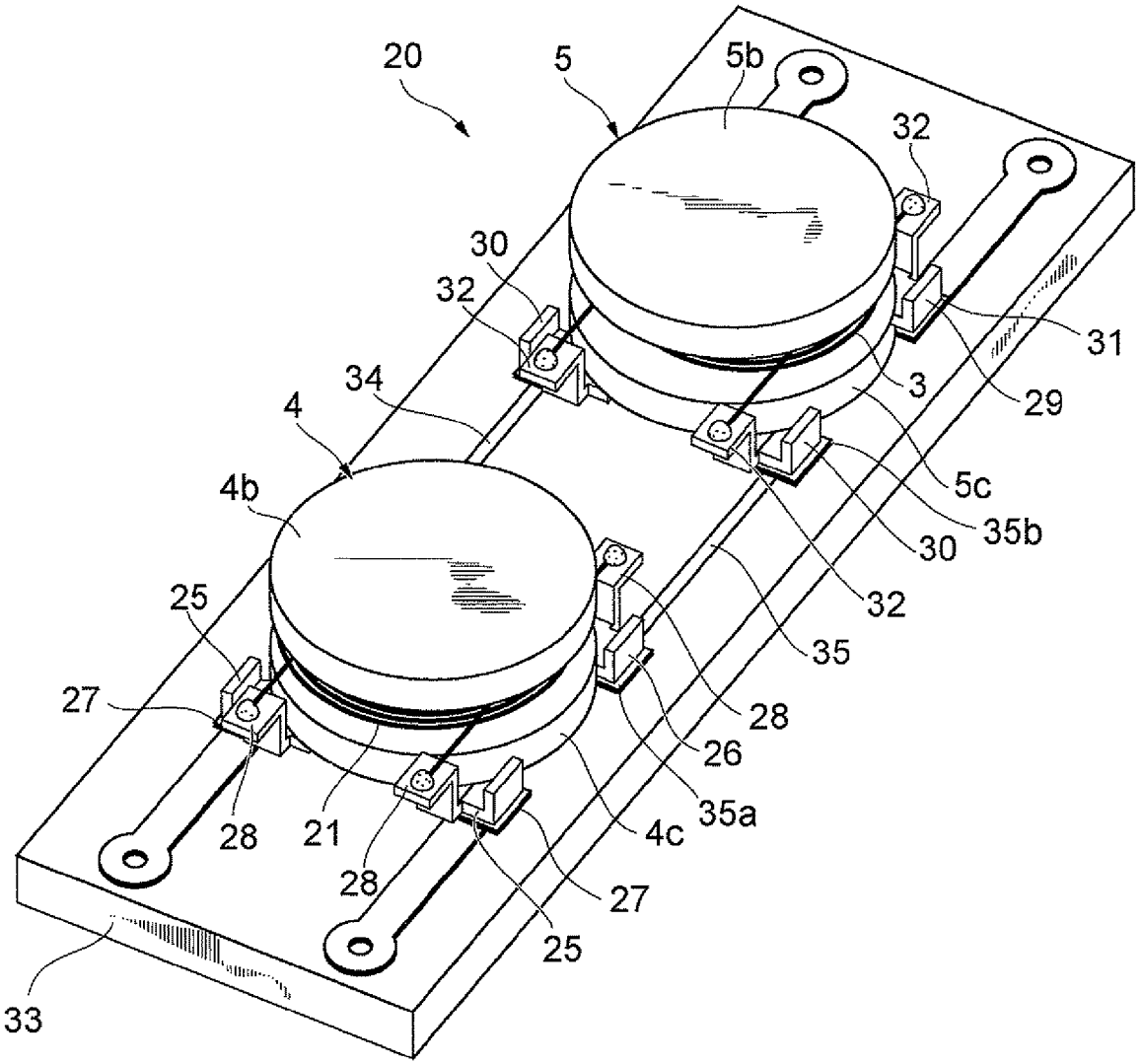
FIG. 5 is a perspective view showing a coil component according to a second embodiment.
Figure 6:
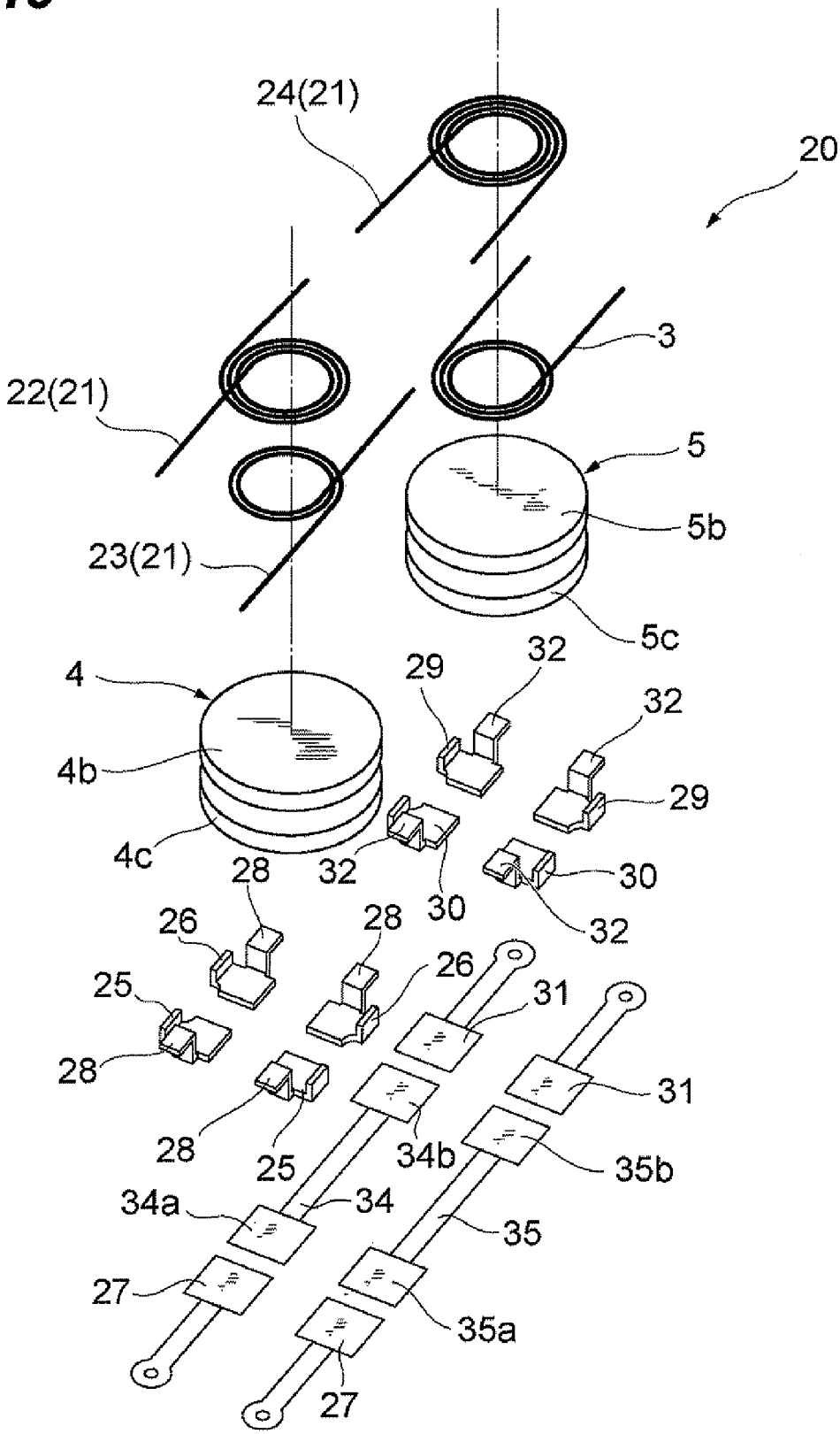
FIG. 6 is an exploded perspective view of the coil component shown in FIG. 5.
Figure 7:
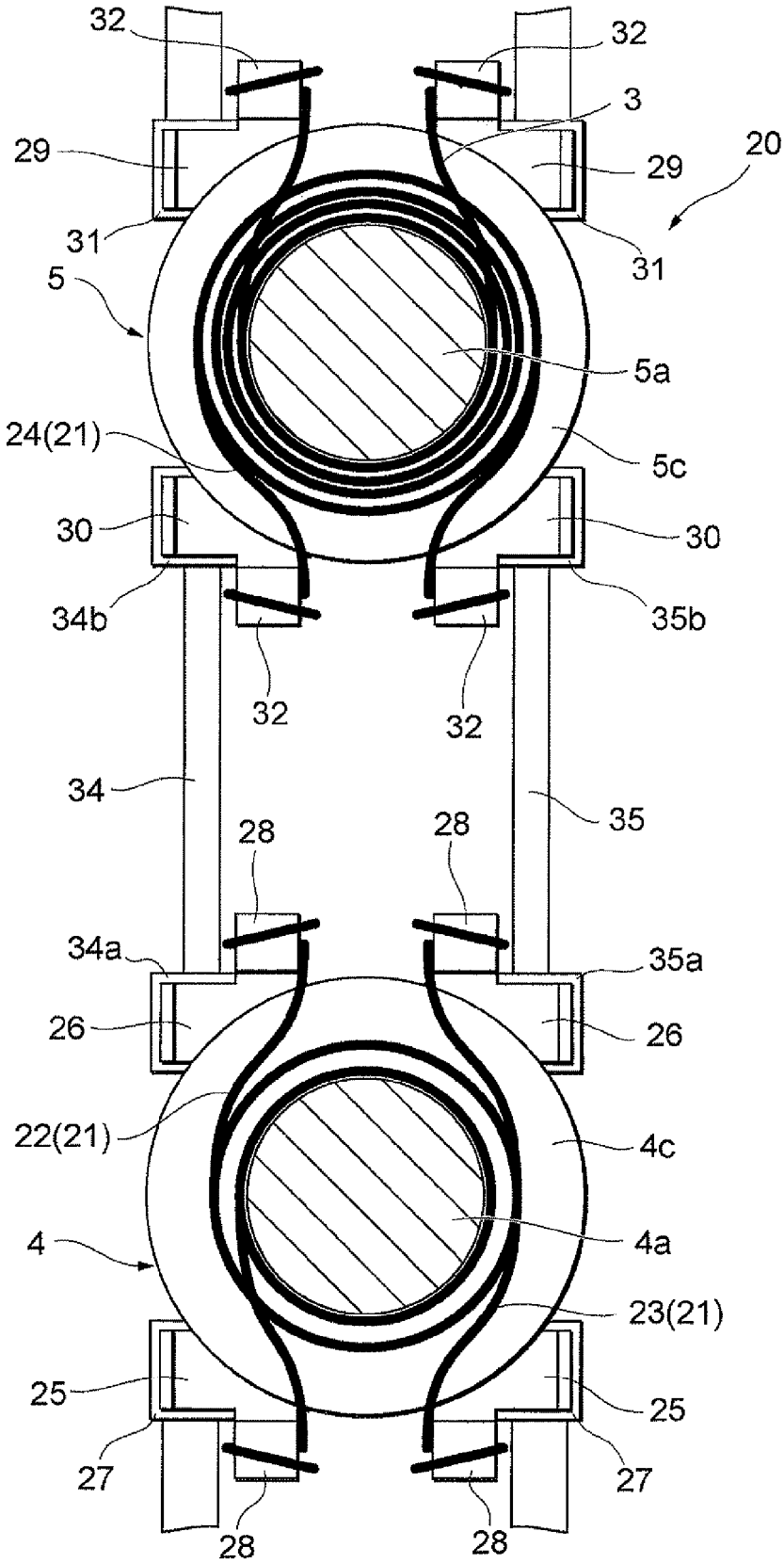
FIG. 7 is a sectional view of the coil component shown in FIG. 5.

FIG. 5 is a perspective view showing the coil component according to the second embodiment. FIG. 6 is an exploded perspective view of the coil component shown in FIG. 5 and FIG. 7 a sectional view of the coil component shown in FIG. 5. In the drawings, identical or equivalent members to those in the first embodiment are denoted by the same reference symbols, without redundant description.

In each drawing, the coil component 20 of the present embodiment has drum cores 4, 5. A part of coil 21 is wound on the winding core portion 4*a* of the drum core 4. The coil 3 and the other part of the coil 21 are wound on the winding core portion 5*a* of the drum core 5. The coil 21 is composed of winding portions 22, 23 wound in layers on the winding core portion 4*a*, and a winding portion 24 wound over the coil 3 on the winding core portion 5*a*. Each of the winding portions 22-24 is formed of a single copper wire.

A pair of metal terminals 25 and a pair of metal terminals 26 are bonded to the lower surface of the flange 4*c* of the drum core 4 with an adhesive or the like in a state in which each pair of metal terminals are juxtaposed on both sides. Each metal terminal 26 is arranged inside each metal terminal 25 (on the drum core 5 side). Each metal terminal 25 is electrically connected to a land 27 on a circuit board 33 made of an insulating base material. Each metal terminal 25, 26 has a nearly L-shaped junction portion 28. The two ends of the winding portion 22 are connected to the respective junction portions 28 of the metal terminals 25, 26 located on one side of the drum core 4, and the two ends of the winding portion 23 are connected to the respective junction portions 28 of the metal terminals 25, 26 located on the other side of the drum core 4.

A pair of metal terminals 29 and a pair of metal terminals 30 are bonded to the lower surface of the flange 5*c* of the drum core 5 with an adhesive or the like in a state in which each pair of metal terminals are juxtaposed on both sides. Each metal terminal 30 is arranged inside each metal terminal 29 (on the drum core 4 side). Each metal terminal 29 is electrically connected to a land 31 on the aforementioned circuit board 33. Each metal terminal 29, 30 has a nearly L-shaped junction portion 32. The both ends of the coil 3 are connected to the junction portions 32 of the respective metal terminals 29, respectively, and the both ends of the winding portion 24 are connected to the junction portions 32 of the respective metal terminals 30, respectively.

Wiring patterns 34, 35, which are connection conductors for electrically connecting the metal terminals 26, 30 to each other, are formed each between each pair of lands 27 and 31 on the surface of the circuit board 33. There are lands 34*a*, 34*b* provided at both ends of the wiring pattern 34 and lands 35*a*, 35*b* provided at both ends of the wiring pattern 35. Each metal terminal 26 is connected to the land 34*a*, 35*a* and each metal terminal 30 to the land 34*b*, 35*b*. This makes the drum cores 4, 5 arranged as magnetically separated from each other on the circuit board 33.

One end of the winding portion 22 and one end of the winding portion 24 are electrically connected through the wiring pattern 34 to each other and one end of the winding portion 23 and the other end of the winding portion 24 are electrically connected through the wiring pattern 35 to each other. A part of the coil 21 wound on the winding core portion 4*a* of the drum core 4 is stretched through the wiring pattern 34, 35 on the circuit board 33 onto the drum core 5 to be wound on the winding core portion 5*a*.

In the present embodiment, as described above, a part of the coil 21 is wound on the winding core portion 4*a* of the drum core 4 and the other part of the coil 21 is stretched through the wiring pattern 34, 35 on the board 33 onto the winding core portion 5*a* of the drum core 5 to be wound thereon, in a state in which the drum cores 4, 5 are arranged as magnetically separated from each other. This facilitates the adjustment of the coupling coefficient between the coils 21, 3 as in the first embodiment.

In this connection, since the length itself of the wiring patterns 34, 35 on the circuit board 33 does not affect the coupling coefficient between coils 21, 3, the drum cores 4, 5 can be arranged, for example, as separated away from each other This increases degrees of freedom for design of the circuit board 33; for example, another component may be mounted between the drum cores 4, 5 on the circuit board 33.

The winding portions 22, 23 are wound only on the winding core portion 4*a* of the drum core 4 and the winding portion 24 is wound only on the winding core portion 5*a* of the drum core 5. For this reason, automatic winding of the coil 21 can be readily carried out using a dedicated winding machine.

Figure 8:
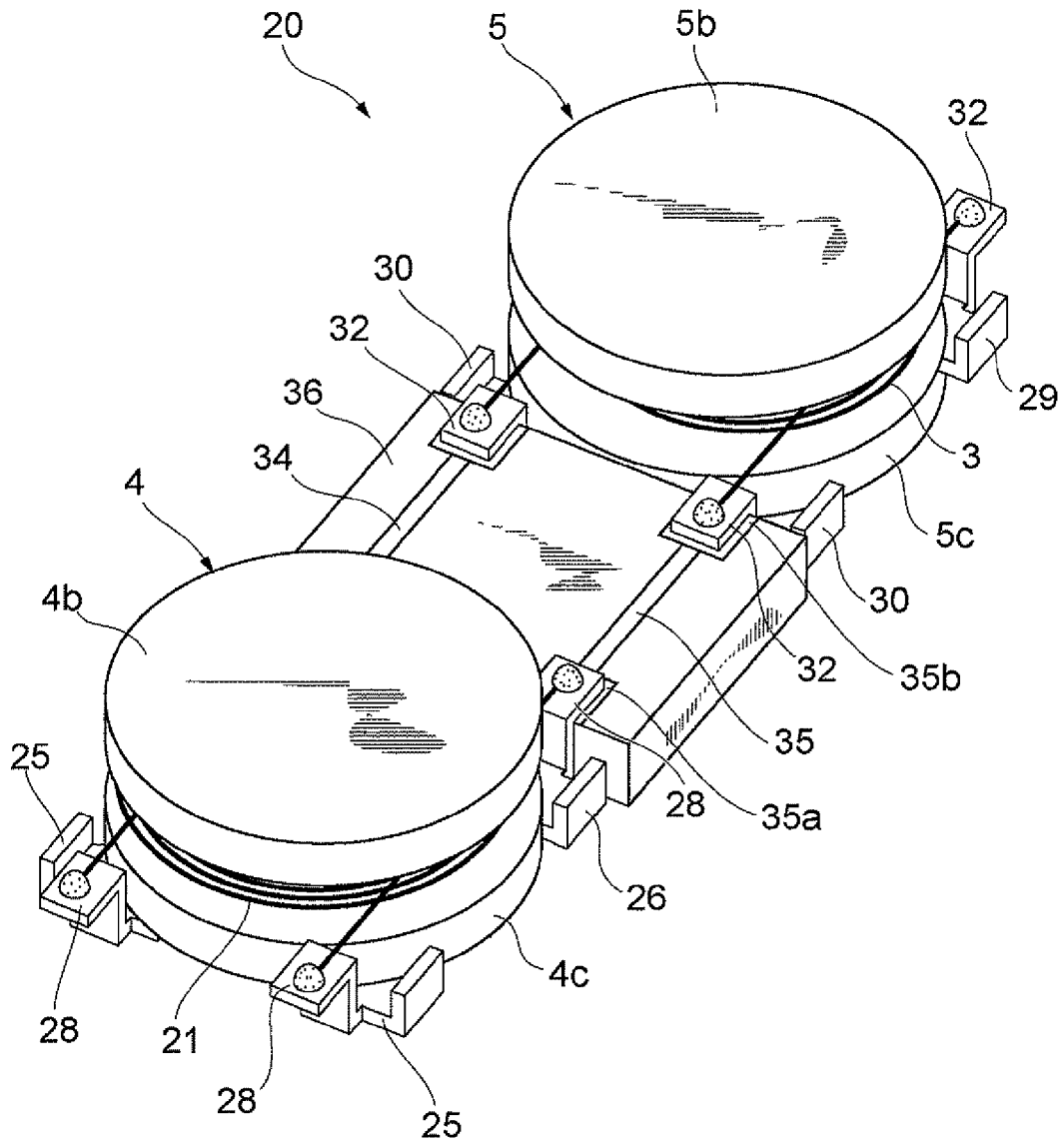
FIG. 8 is an exploded perspective view showing a modification example of the coil component shown in FIG. 5.

FIG. 8 is a perspective view showing a modification example of the coil component 20 of the second embodiment described above. In the same drawing, a substrate 36 made of an insulating base material is arranged between the drum cores 4, 5. This makes the drum cores 4, 5 magnetically separated from each other. The aforementioned wiring patterns 34, 35 are formed on a surface of the substrate 36. The junction portion 28 of each metal terminal 26 is bonded to the land 34*a*, 35*a* and the junction portion 32 of each metal terminal 30 is bonded to the land 34*b*, 35*b*. The other configuration is the same as in the second embodiment.

The present invention is by no means limited to the above embodiments. For example, the above embodiments adopt the configuration wherein the drum cores 4, 5 are coupled by the coupling member 6 or the like, or the configuration wherein the drum cores 4, 5 are mounted on the circuit board 33 with the wiring patterns 34, 35 thereon. Without having to be limited to these configurations, the drum cores 4, 5 may be simply separated through a space from each other, for magnetically separating the drum cores 4, 5 from each other. In this case, a part of the coil wound on the winding core portion 4*a* of the drum core 4 may be directly stretched onto the drum core 5, or may be stretched through some connection conductor onto the drum core 5.

The above embodiments adopt the configuration wherein only a part of the coil wound on the winding core portion 4*a* of the drum core 4 is also wound on the winding core portion 5*a* of the drum core 5. However, without having to be limited to this configuration, it is also possible to adopt a configuration wherein a part of the coil wound on the winding core portion 4*a* is also wound on the winding core portion 5*a* and wherein a part of the other coil wound on the winding core portion 5*a* is also wound on the winding core portion 4*a*.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A coil component comprising:

a first core having a winding core portion;

a second core having a winding core portion;

a first coil wound on the winding core portion of the first core;

a second coil wound on the winding core portion of the second core;

a coupling member which is made of a nonmagnetic material and which couples the first core to the second core;

a pair of first terminals connected to both ends of the first coil, respectively; and a pair of second terminals connected to both ends of the second coil, respectively, wherein the first and second coils are not electrically connected to each other between the pair of first terminals and between the pair of second terminals, wherein a part of the first coil is wound on the winding core portion of the second core, and wherein the first core and the second core are arranged as magnetically separated from each other by arranging the coupling member between the first core and the second core.

2. The coil component according to claim 1, wherein the part of the first coil is directly stretched onto the winding core portion of the second core to be wound thereon.

3. The coil component according to claim 1, wherein the part of the first coil is stretched through a connection conductor onto the winding core portion of the second core to be wound thereon.

4. The coil component according to claim 3, wherein the connection conductor is a wiring pattern formed on a substrate.

5. The coil component according to claim 1, wherein each of the first core and the second core is a drum core further having flange portions provided at both ends of the winding core portion.

* * * * *